US006463995B1

(12) United States Patent
Lehman et al.

(10) Patent No.: US 6,463,995 B1
(45) Date of Patent: Oct. 15, 2002

(54) DEVICE FOR CASTING OF METAL

(75) Inventors: Anders Lehman, Bromma; Erik Svensson; Tord Kroon, both of Västerås, all of (SE)

(73) Assignee: ABB AB, Vasteras (SE)

( * ) Notice: Subject to any disclaimer, the term of this patent is extended or adjusted under 35 U.S.C. 154(b) by 0 days.

(21) Appl. No.: 09/623,257

(22) PCT Filed: Feb. 18, 1999

(86) PCT No.: PCT/SE99/00223

§ 371 (c)(1),
(2), (4) Date: Aug. 31, 2000

(87) PCT Pub. No.: WO97/17151

PCT Pub. Date: May 15, 1997

(30) Foreign Application Priority Data

Mar. 2, 1998 (SE) ..... 9800638

(51) Int. Cl.[7] ..... B22D 11/00; B22D 27/02

(52) U.S. Cl. ..... 164/418; 164/471; 164/507; 164/443

(58) Field of Search ..... 164/418, 471, 164/507, 443

(56) References Cited

U.S. PATENT DOCUMENTS 5,375,648 A * 12/1994 Idogawa et al. ..... 164/507

5,799,720 A * 9/1998 Ross et al. ..... 164/507

FOREIGN PATENT DOCUMENTS

| | | | | |
|---|---|---|---|---|
| JP | 4-17949 | * | 1/1992 | ..... 164/507 |
| WO | WO 9633829 | | 10/1996 | |
| WO | WO 9717151 A1 | | 5/1997 | |

* cited by examiner

*Primary Examiner*—Tom Dunn
*Assistant Examiner*—I. H. Lin
(74) *Attorney, Agent, or Firm*—Dykema Gossett PLLC

(57) ABSTRACT

A device for continuous or semi-continuous casting of metal has a cooled continuous casting mold assembly and an inductive coil arranged at the top end of the mold assembly. The mold assembly is divided into at least two mold assembly parts separated and electrically insulated from each other by partitions, which are oriented in the casting direction and where each partition is formed with an electrically insulating barrier. Each mold assembly part has a mold part associated with a corresponding mechanically supporting mold back-up structure part, and an electrical conductor, with an electrical conductivity higher than the electrical conductivity of the back-up structure. The conductor is arranged with the mold back-up structure part on the side of the mold back-up structure part facing away from the mold, the outside face.

13 Claims, 2 Drawing Sheets

DEVICE FOR CASTING OF METAL

CROSS-REFERENCE TO RELATED APPLICATION

This application is a 371 of PCT/SE99/00223, filed Feb. 18, 1999.

TECHNICAL FIELD

The present invention relates to a device for continuous or semi-continuous casting of metal or metal alloys into an elongated strand, where the strand is cast using a device comprising a cooled continuous casting mold and an inductive coil arranged at the top end of the mold. The coil is supplied with a high frequency alternating current from a power supply. The invented device exhibits low induced power losses.

BACKGROUND ART

During continuous or semi-continuous casting of metals and metal alloys, a hot metal melt is supplied to a cooled continuous casting mold, i.e. a mold which is open in both ends in the casting direction. The mold is typically water-cooled and surrounded and supported by a supportive back-up structure. Typically the back-up structure comprises a plurality of support beams or back-up plates provided with internal cavities or channels for a coolant such as water. Melt is supplied to the mold where the metal is solidified and a cast strand is formed as it is passed through the mold. A cast strand leaving the mold, comprises a solidified, self-supporting surface layer or shell around a residual melt. Generally it can be said that conditions of initial solidification is critical for both quality and productivity. A lubricant is typically supplied to the upper surface of the melt in the mold. The lubricant serves many purposes, amongst others it will prevent the skin of the cast strand first developed from sticking to the mold wall. Normal adherence between oscillation show as so called oscillation marks. Should the solidified skin stick or adhere more severely to the mold it will show as severe surface defects and in some cases as ripping of the first solidified skin. For large dimension strands of steel the lubricant is predominantly a so-called mold powder comprising glass or glass forming compounds that is melted by the heat at the meniscus. The mold powder is often continuously added to the upper surface of the melt in the mold during casting, as an essentially solid, free flowing particulate powder. The composition of a mold powder is customized. Thereby the powder will melt at a desired rate and lubrication will be provided at the desired rate to ensure lubrication. A too thick layer of lubricant between mold and cast strand will also effect the solidification conditions and surface quality in an undesired way, thus the thermal conditions at the meniscus need to be controlled. For smaller strands and for non-ferrous metals oil, typically vegetable oil, or grease is used as lubricant. Irrespective of what type of mold lubricant is used it should preferably be fed into the interface cast strand/mold at an even rate sufficient to form a thin uniform film in the interface to avoid surface defects originating from adherence between mold and strand. A too thick film might cause uneven surface and disturbs the thermal situation.

Heat losses and overall thermal conditions at the meniscus are predominantly controlled by the secondary flow that is developed in the mold. The use of inductive HF heaters for influencing the thermal situation at the top end is discussed in e.g. U.S. Pat. No. 5,375,648 and in earlier not yet published Swedish Patent Application No. SE-A-9703892-1. High thermal losses are compensated by a supply of heat to the upper surface, either by a controlled upward flow of hot melt or by a heater, otherwise the meniscus can start to solidify. Such a solidification will severely disturb the casting process and destroy the quality of the cast product in most aspects.

A high frequency inductive heater arranged at the top end of a continuous casting mold will provide means to improve the temperature control at the upper surface of the melt, the meniscus, and the same time generate compressive forces acting to separate the melt and the mold, thereby reducing the risk for sticking, reducing oscillation mark and in general provide improved conditions for mold lubrication. This technique, which today often is referred to as electromagnetic casting, EMC, for an improved lubrication and thus improved surfaces is primarily attributed to the compressive forces acting to separate the melt from the mold. The inductive heater or coil may be of single-phase or polyphase design. Preferably a high-frequency magnetic alternating field is applied. Typically the inductive coil is supplied with an alternating current having a base frequency of 50 Hz or more, preferably, at least when a mold assembled from four mold plates are used, with an alternating current having a base frequency of 150–1000 Hz. Most preferred for large size slab molds is an alternating current having a base frequency of about 200 Hz. The compressive forces, generated by the high frequency magnetic field, reduce the pressure between the mold wall and the melt, whereby the conditions for lubrication are significantly improved. Surface quality of the cast strand is improved and the casting speed can be increased without risking the surface quality. Oscillation is primarily applied to ensure that the cast strand leaves the mold. As the compressive forces act to separate the melt from the mold they will minimize any contact between the melt and mold during initial solidification of the skin and improve the feed of lubricant hereby further improving the surface quality of the cast strand. Thus the use of an inductive coil supplied with a high frequency alternating current and arranged at the meniscus is believed to provide a means to substantially improve surface quality, internal structure, cleanliness and also productivity. However, it has been noted that the induced power losses are high. The typical mold for casting large size slabs comprises a mold with four mold plates made in copper or a copper alloy. These mold plates are backed by a supporting back-up structure of plates and/or beams. The beams comprises internal channels or cavities for a coolant such as water and it is known to use stainless steel in this back-up structure to reduce the inductive power losses, but they are still substantial. For example has an EMC device for a continuous casting mold for casting of large size slabs with a dimension of 2000×250 mm and using a frequency of about 200 Hz or more in operation shown that only about 20 to 30% of the total active power is induced in the melt, while about 3 to 10% is induced in the Cu mold, about 15 to 25% is lost in the coil and about 50% is induced in the mold support beams or the part of the mold support system which normally is called backup plates. The back-up plates in the example were made of stainless steel and comprised internal cooling channels for flowing water or other suitable coolant. The total active power required to obtain the desired compressive forces acting to separate the melt and the mold were in the example calculated to be about 3400 kW when a alternating current with a frequency of 200 Hz was used, wherein the following power distribution was calculated;

about 800 kW induced in the melt, about 250 kW induced in the Cu mold, about 1700 kW induced in the stainless steel back-up plates, and about 650 kW generated in the coil.

SUMMARY OF THE INVENTION

It is an object of the invention to provide a device for continuous casting of metal strand, wherein the conditions for the initial solidification of the case metal in the mold are improved and in particular the conditions for mold lubrication is improved by the use of an EMC that exhibit low induced power losses. In particular, it is an object of the present invention to provide a device where the power induced in the mold support beams, back-up plates is substantially reduced. The continuous casting device according to the present invention shall ensure good and controlled thermal, flow, lubrication and overall conditions at the top end of the mold, thus attaining considerable improvements with respect to quality and productivity.

DESCRIPTION OF THE INVENTION

A device for continuous or semi-continuous casting of metal typically comprises;

a cooled continuous casting mold assembly, means for supplying hot melt to the mold, means for extracting and/or receiving a cast strand formed in the mold from the mold, and an inductive coil arranged at the top end of the mold. The continuous casting mold assembly comprises a mold associated and mechanically supported by a mechanically supporting mold back-up structure. The mold suitable exhibits an electrical conductivity higher than the electrical conductivity of the back-up structure and is typically divided into at least two segments with partitions oriented essentially in the casting direction. The coil generates, when supplied with an alternating electric high frequency current, a high frequency magnetic field which is adopted to act upon the melt in the mold, whereby heat is developed in the melt and compressive forces acting to separate the melt from the mold wall is generated. The partitions comprises an electrically insulating barrier. These barriers cut the current paths of any electrical currents induced in the mold by the magnetic field thereby facilitating a good penetration of the magnetic field to the melt in the mold and minimizing of the induced power losses in the mold assembly. Such a device for continuous casting of metals is according to the present invention and to achieve the objects defined in the foregoing arranged with the continuous casting mold assembly divided into at least two mold assembly segments separated and electrically insulated from each other by partitions oriented essentially in the casting direction. Each mold assembly segment comprises a mold segment associated with a corresponding mechanically supporting mold back-up structure segment and is separated from any other mold assembly segment by partitions comprising an electrically insulating barrier. An electrical conductor, with an electrical conductivity higher than the electrical conductivity of the back-up structure, is arranged associated with the mold back-up structure segment on the side of the mold back-up structure facing away from the mold, the outside face. This conductor provides a favorable return path for any current induced by the high frequency magnetic field such that the induced power losses are minimized in the backup structure.

Typically a mold for casting of blooms and slabs and often also for casting of billets has an essentially square or rectangular cross section in the casting direction and is assembled from four mold assembly plates. The mold assembly plates are separated from each other by electrically insulating barriers and each mold assembly plate comprises a mold plate of a material exhibiting a high thermal and electrical conductivity and a back-up plate. Each back-up plate is on its out-side face in accordance with the present invention associated with a good electrical conductor. This conductor provides as in the general concept a favorable return path for any current induced by the high frequency magnetic field in a mold assembly plate such that the induced power losses are minimized in the back-up plate. The typical mold for casting large size slabs comprises a mold assembly with four mold assembly plates, two narrow side assembly plates facing each other and two wide side plates facing each other. These mold assembly plates are electrically insulated from each other and arranged with the conductor on the outside face to provide the favorable return path in accordance with the present invention.

The conductor covers according to one embodiment of the present invention essentially the complete outside face of the back-up segment or plate. Alternatively the conductor is a band covering essentially the whole width of the outside face of the mold back-up segment or plate. This band is oriented essentially transverse to the casting direction and essentially in the direction of any currents induced by the magnetic field. The conductor band preferably has a band width at least covering essentially the total height of the coil.

According to one further embodiment the conductors are bent around the sides of the back-up plates and in direct electrical contact with the mold plates such that the conductor and the mold plate of each mold assembly plate provides a closed electrical circuit surrounding the back-up segment. This embodiment facilitate the use of less expensive magnetic steels, carbon steels, for the backup plates. To minimize the inductive power losses in the back-up plates they are otherwise typically made from stainless steel. The mold plates and the conductors typically comprises copper.

Any currents induced will in a mold according to the present invention, as the electrical conductivity is substantially higher for the mold plate and the conductor than for the back-up plate, predominantly flow in a circuit provided by the copper mold plates on the inside of the mold and in the conductor on the outside of the mold.

According to one preferred embodiment the mold and the conductor both comprises copper or other metal or metal alloy with a suitable electrical and thermal conductivity. Preferably the conductor has a thickness corresponding to one penetration depth or more to achieve the desired substantial reduction of the induced power losses. There is from technical point no upper limit to this thickness but as the reduction in losses asymptotic approaches a specific value as the thickness of the conductor is increased there is for economical and practical reasons no point in using conductors substantially thicker than the thickness corresponding to this specific value. It is always favorable due to the costs aspect to minimize the dimensions of the mold and the back-up structure or any other part contained in the mold assembly. For other reasons such as a desire to cool the conductor can the thickness be increased to provide the required volume for channels for a flowing coolant. These channels can be arranged within the conductor or in the interface between the conductor and the back-up structure or plate. Of course can fins or other cooling means be arranged on the face of the conductor facing away from the mold, provided that a sufficient flow of a cooling gas can be supplied around such cooling fins.

Typically the inductive coil is supplied with an alternating current having a base frequency of 50 Hz or more, preferably, at least when a mold assembled from four mold plates are used, with an alternating current having a base frequency of 150–1000 Hz. Most preferred for large size slab molds is an alternating current having a base frequency of about 200 Hz used.

Repeating the same example as described in the prior art for a slab mold with dimension of 2000×250 mm a total active power required to obtain the desired compressive forces acting to separate the melt and the mold were in the example about 2150 kW when a alternating current with a frequency of 200 Hz was used, wherein the following power distribution was calculated;

about 800 kW induced in the melt, about 200 kW induced in the Cu mold, about 150 kW induced in the stainless steel back-up plates, about 350 kW induced in the copper based conductor, and about 650 kW generated in the coil.

BRIEF DESCRIPTION OF THE DRAWINGS

In the following the invention will be explained in greater detail and be exemplified by means of preferred embodiment with reference to the accompanying figures.

DESCRIPTION OF THE PREFERRED EMBODIMENTS

Figure 3:
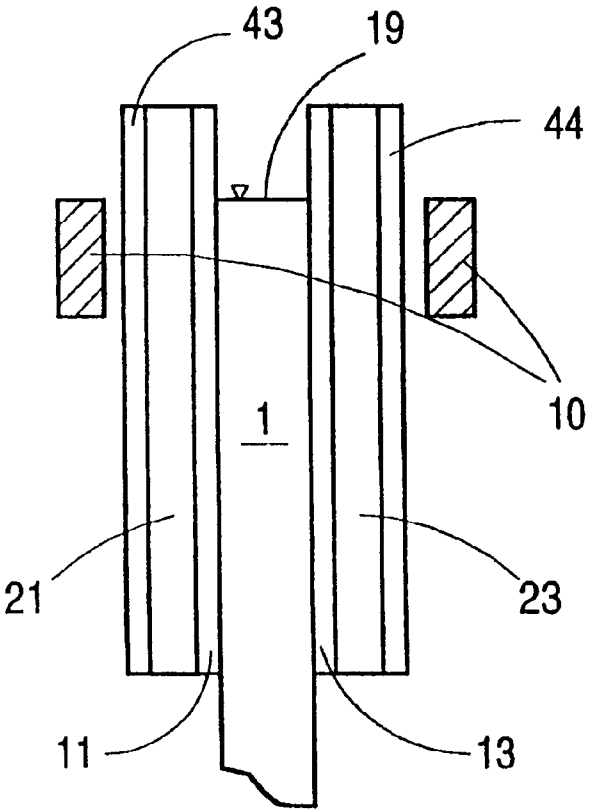
FIG. 3 shows a cut along the casting direction exemplifying one configuration of the conductor used for the devices shown in FIG. 1 and 2.
Figure 1:
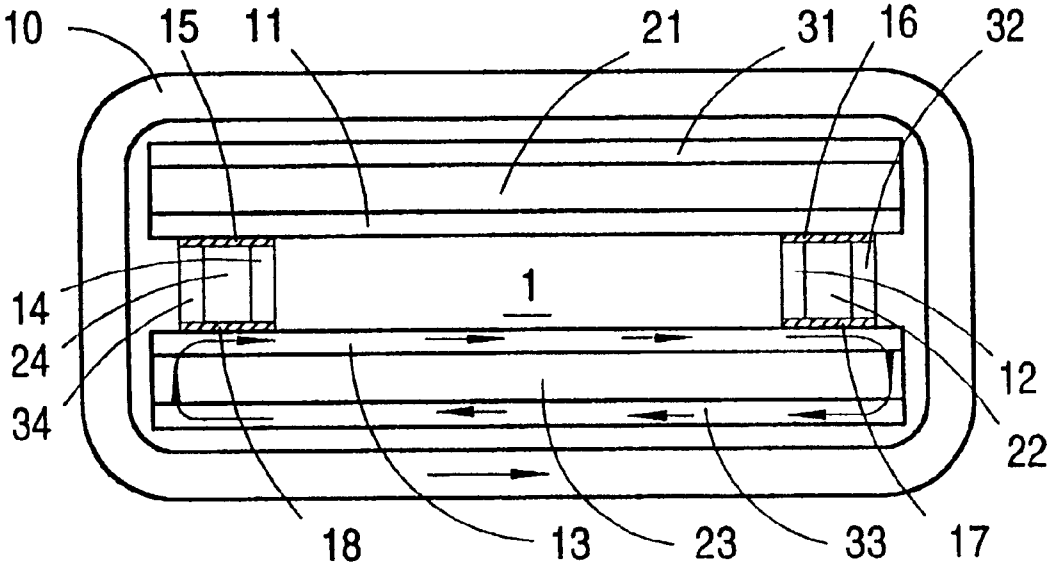
FIG. 1 shows a cut across the casting direction through a device according to one embodiment of the present invention, the cut is made at the top end of a mold for continuous casting of metal with a electromagnetic field generating device arranged around the mold.
Figure 4:
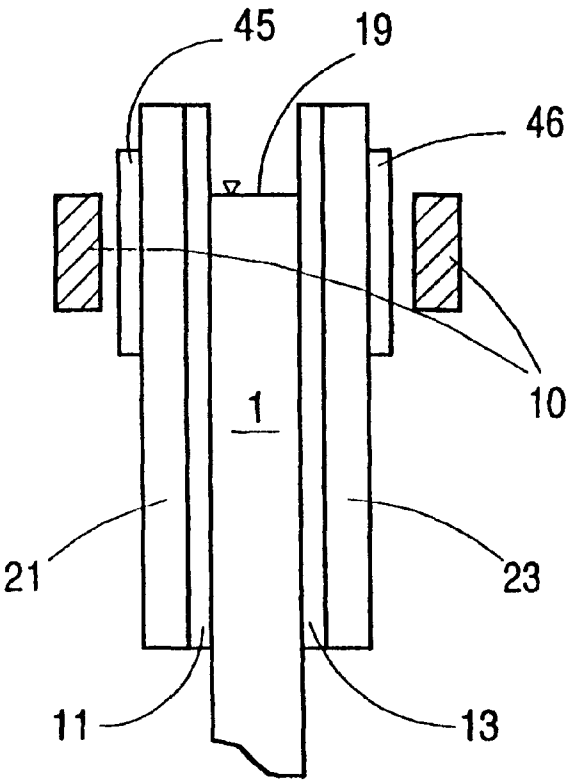
FIG. 4 shows a cut along the casting direction exemplifying one alternative configuration of the conductor used for the devices shown in FIG. 1 and 2.
Figure 2:
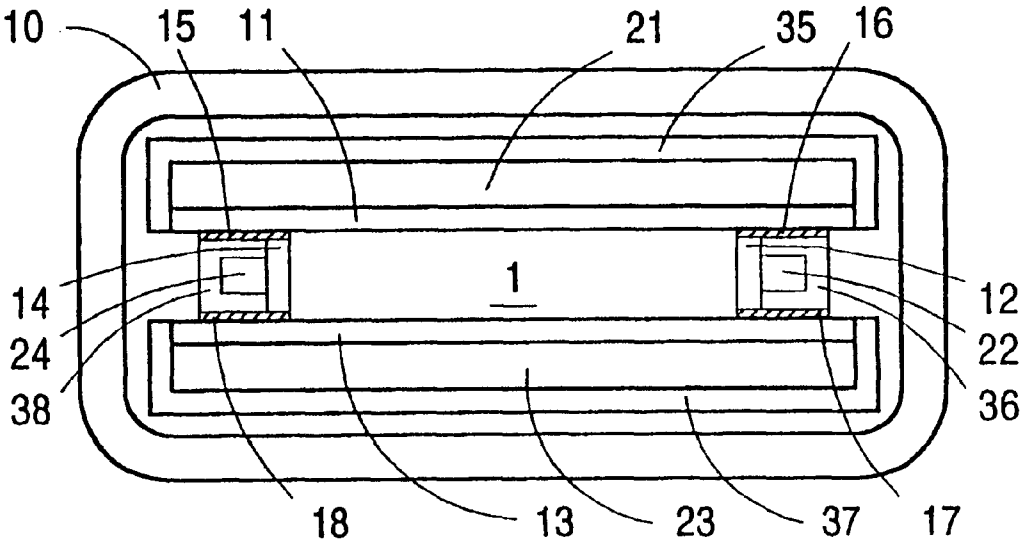
FIG. 2 shows a cut across the casting direction through a device according to one alternative embodiment of the present invention.

The mold assembly for continuous casting of metal shown in the FIGS. 1 to 4 all comprises four mold assembly plates surrounded by an inductive coil 10. Two plates on the narrow sides facing each other and two plates on the wide sides also facing each other. All four plates have a composite structure and comprises each; a mold plate 11, 12, 13, 14, a mold back-up plate 21, 22, 23, 24 and a conductor 31, 32, 33, 34, 35, 36, 37, 38. The mold plate 11, 12, 13, 14 typically comprises copper or a copper-based alloy, which when suitable can be provided with a wear liner or coating on the inside facing the melt 1 during operation. Further the mold plates 11, 12, 13, 14 exhibit a high thermal and electrical conductivity. The mold back-up plates 21, 22, 23, 24 are typically made from steel beams and comprises internal channels or cavities for a flowing coolant such as water. Partitions 15, 16, 17, 18 comprising an electrically insulating barrier, not illustrated, are arranged to separate and electrically insulate the composite mold assembly plates from each other. When used for EMC together with an inductive coil 10 stainless steel is preferably used for the back-up plates to minimize the induced power losses. However with the bent around conductors 35, 36, 37, 38 shown in FIG. 2 also other less expensive construction materials can be used as the conductors 35, 36, 37, 38 are bent around the sides of the back-up plates 21, 22, 23, 24 and in direct electrical contact with the mold plates 11, 12, 13, 14 such that the conductor and the mold plate of each mold assembly plate provides a closed electrical circuit surrounding the back-up plate or beam. The mold assembly shown in FIG. 1 illustrates an embodiment where the conductor 31, 32, 33, 34 is associated only with the outside face of its associated back-up plate 21, 22, 23, 24 to provide the favorable return path in accordance with the present invention. The coil 10 is preferably arranged at the top end of the mold as shown in FIGS. 3 and 4 to generate and apply a high frequency magnetic field to act on the melt 1 in the top end of the mold during casting.

A continuous casting mold assembly is open in both ends in the casting direction and is arranged with cooling means and means for ensuring that the formed cast strand continuously leaves the mold. The cooled mold is continuously supplied with a primary flow of hot melt, the hot metal is cooled and a cast strand is formed in the mold. The mold is usually a water-cooled copper mold. The mold and any support beam comprises internal cavities or channels, not shown, in which the water, flows during casting. During casting a primary flow of hot melt is supplied to the mold. As the metal passes through the mold it is cooled and at least partly solidified whereby a cast strand 1 is formed. When the cast strand leaves the mold, it comprises a solidified, self-supporting surface shell around a remaining residual melt. Generally it can be said that the surface conditions and of course the cast structure is highly dependent on the conditions of initial solidification. But also metal cleanliness will depend on the conditions in the top end of the mold, i.e. the locations at which the metal starts to solidify and the conditions at the interface mold/strand and at the meniscus. To control the thermal situation at the top end of the mold and the lubricating conditions is a device for generation of a high frequency magnetic field e.g. an inductive coil 10 arranged at this top end at level with the top surface of the melt in the mold, the meniscus 19.

The coil 10 as shown in FIGS. 1 to 4 is arranged outside the mold assembly and the high frequency magnetic field generated must penetrate the mold assembly and into the melt 1. The inductive coil 10 may be a single-phase or a poly-phase device. When the high frequency magnetic alternating field is applied to act on the melt, heat is developed in the melt so that the temperature of the melt adjacent to the meniscus 19 can be controlled. At the same time and maybe more important compressive forces acting on the melt are developed by the high frequency alternating field. The compressive forces reduce the pressure between the mold plates 11, 12, 13, 14 and the melt 1 and thus improve the condition for lubrication significantly. Improvements obtained when casting according to the present invention relates to many quality and productivity aspects such as;

Heat efficiency;

More mechanically stable mold;

Cleanliness;

Surface quality;

Controlled cast structure;

Reduced down-time; and

Provisions to increase casting speed and /or reduce oscillation.

Two alternative conductor configurations are illustrated by FIG. 3 and 4. To facilitate the favorable return path for any currents induced in a mold assembly plate it is typically sufficient to provide the conductor 45, 46 only at level with the coil 10 and with a height essentially the same or larger than the height of the coil 10 as shown in FIG. 4 but for other reasons it might be desirous to extend the conductor 43, 44 to the full length of the mold assembly as shown in FIG. 3.

What is claimed is:

1. A device for continuous or semi-continuous casting of metal comprising a continuous casting mold assembly having a top end and an inductive coil arranged at the top end of the mold assembly, wherein the mold assembly comprises a mold including at least two mold parts in confronting relation forming a channel having an inlet at the top end, and partitions for separating the mold parts in spaced confronting relationship, and a mold back-up structure having a selected electrical conductivity located adjacent the mold parts to mechanically support said mold parts, and each partition includes an electrically insulating barrier for electrically insulating the mold parts from each other, said mold assembly being oriented essentially in the casting direction; and an electrical conductor having an electrical conductivity higher than the electrical conductivity of the back-up structure, being arranged adjacent with the mold back-up structure on a side thereof spaced away from the mold channel.

2. A device according to claim 1, wherein the mold assembly is arranged for casting a strand with an essentially square or rectangular cross section and wherein the mold parts include four mold assembly plates separated and electrically insulated from each other by the partitions, each mold assembly plate comprises;

a flat plate having inner and outer sides, and the back-up structure comprises a back-up plate for each flat plate having an inner and outer side, said back-up plate covering essentially the outer side of each flat plate and;

the electrical conductor comprises a plate having an inner side in abutment with the outer side of the back-up plate.

3. A device according to claim 2, wherein the conductor covers essentially the outer side of the mold back-up part.

4. A device according to claim 1, wherein the conductor is a band oriented essentially transverse to the casting direction.

5. A device according to claim 4, wherein the conductor band has a length covering essentially the outer side of the mold back-up part.

6. A device according to claim 4, wherein the coil has a height and the conductor band has a width covering essentially the height of the coil.

7. A device according to claim 1, wherein the back-up part has lateral sides and the conductor extends around the lateral sides of the mold back-up part and wherein the conductor is in electrical contact with the mold part such that the conductor and mold part provide a closed electrical circuit surrounding the mold back-up part.

8. A device according to claim 1, wherein the mold parts and the conductor comprise copper plates.

9. A device according to claim 1, wherein the coil produces a magnetic field having selected penetration depth and the conductor has a thickness corresponding to at least one penetration depth of the magnetic field.

10. A device according to claim 1, wherein the coil is supplied with an alternating current having a base frequency of at least 50 Hz.

11. A device according to claim 10, wherein coil is supplied with an alternating current having a base frequency of about 150–1000 Hz.

12. A device according to claim 1, wherein the conductor has channels for carrying a flowing coolant.

13. A device according to claim 12, wherein the channels are arranged in an interface between the conductor and the back-up structure.

* * * * *